US009656115B2

(12) United States Patent
Young

(10) Patent No.: US 9,656,115 B2
(45) Date of Patent: May 23, 2017

(54) EXERCISE DEVICE INCLUDING ELASTIC CLOSED LOOP RESISTANCE TENSION BAND

(71) Applicant: Dr. Fit 365, LLC., Gahanna, OH (US)

(72) Inventor: Tremaine Young, Gahanna, OH (US)

(73) Assignee: Dr. Fit365, LLC., Gahanna, OH (US)

( * ) Notice: Subject to any disclaimer, the term of this patent is extended or adjusted under 35 U.S.C. 154(b) by 163 days.

(21) Appl. No.: 14/546,596

(22) Filed: Nov. 18, 2014

(65) Prior Publication Data

US 2015/0141217 A1 May 21, 2015

Related U.S. Application Data

(60) Provisional application No. 61/905,776, filed on Nov. 18, 2013.

(51) Int. Cl.

| | |
|---|---|
| ***A63B 21/055*** | (2006.01) |
| ***A63B 21/04*** | (2006.01) |
| ***A63B 21/002*** | (2006.01) |
| ***A63B 21/068*** | (2006.01) |
| ***A63B 21/16*** | (2006.01) |
| ***A63B 22/20*** | (2006.01) |
| ***A63B 21/00*** | (2006.01) |
| ***A63B 23/035*** | (2006.01) |
| ***A63B 23/12*** | (2006.01) |

(52) U.S. Cl.

CPC ..... *A63B 21/0442* (2013.01); *A63B 21/0023* (2013.01); *A63B 21/0555* (2013.01); *A63B 21/0557* (2013.01); *A63B 21/068* (2013.01); *A63B 21/169* (2015.10); *A63B 21/1645* (2013.01); *A63B 21/4031* (2015.10); *A63B 21/4033* (2015.10); *A63B 21/4035* (2015.10); *A63B 21/4043* (2015.10); *A63B 22/205* (2013.01); *A63B 23/03508* (2013.01); *A63B 23/03541* (2013.01); *A63B 23/1218* (2013.01); *A63B 2210/50* (2013.01); *A63B 2225/09* (2013.01); *A63B 2225/093* (2013.01)

(58) Field of Classification Search

CPC ..... A63B 21/0552; A63B 21/4035; A63B 21/00043; A63B 21/0557; A63B 21/0004; A63B 21/0442; A63B 23/12; A63B 21/0555; A63B 21/00061

USPC ..... 482/121–126, 129

See application file for complete search history.

(56) References Cited

U.S. PATENT DOCUMENTS 4,477,073 A * 10/1984 Koch ..... A63B 21/1627 482/129
4,733,862 A * 3/1988 Miller ..... A63B 21/0552 482/125
4,852,874 A * 8/1989 Sleichter, III ..... A63B 21/0004 482/122

(Continued)

*Primary Examiner* — Andrew S Lo
(74) *Attorney, Agent, or Firm* — Sand & Sebolt

(57) ABSTRACT

A training device includes a continuous elastic loop having attached thereon at least one of a hand grip or a foot cradle, a non-scissoring sleeve slidably wrapped around a first portion of the continuous elastic loop, and an anchoring portion non-slidably connected to the non-scissoring sleeve. The elastic loop provides uniform resistance (i.e., tension) while providing total body muscle engagement whether conducting isometric, concentric, or eccentric muscle contractions. The training device provides portability, ease of use and greater effectiveness for the user while exercising.

20 Claims, 8 Drawing Sheets

(56) References Cited

U.S. PATENT DOCUMENTS 4,909,505 A * 3/1990 Tee ..... A63B 21/00043 482/121
5,556,369 A * 9/1996 Roberts ..... A63B 21/4017 482/131
5,730,687 A * 3/1998 Ledany ..... A63B 21/0004 482/121
5,813,954 A * 9/1998 Wilkinson ..... A63B 21/0004 482/124
6,036,625 A 3/2000 Woodruff
6,322,483 B1 * 11/2001 Rotella ..... A63B 21/0552 482/121
6,450,929 B1 * 9/2002 Markham ..... A63B 21/0552 482/121
8,012,071 B2 * 9/2011 Grisdale ..... A63B 21/0004 482/122
8,142,337 B2 3/2012 Hall
8,979,716 B1 * 3/2015 Rawlins ..... A63B 21/0442 482/129
9,259,605 B1 * 2/2016 Puig ..... A63B 7/00
2003/0130099 A1 * 7/2003 Chen ..... A63B 21/0004 482/126
2003/0158024 A1 * 8/2003 Saure ..... A63B 21/0552 482/126
2005/0079963 A1 * 4/2005 Lin ..... A63B 21/0004 482/126
2008/0139369 A1 * 6/2008 Vigilia ..... A63B 21/0004 482/124
2009/0286661 A1 * 11/2009 Campbell ..... A63B 21/0023 482/124
2010/0173760 A1 * 7/2010 Hall ..... A63B 21/0552 482/129
2010/0292056 A1 * 11/2010 Birch ..... A63B 21/00185 482/129
2011/0172067 A1 * 7/2011 Glauser ..... A63B 21/0004 482/122
2011/0306477 A1 * 12/2011 Keen ..... A63B 21/02 482/122
2012/0108403 A1 * 5/2012 Zandman-Zeman A63B 21/0004 482/121
2012/0220436 A1 8/2012 Zoltak
2012/0245002 A1 * 9/2012 Todd ..... A63B 21/4025 482/124
2012/0329618 A1 * 12/2012 White ..... A63B 21/0552 482/126
2012/0329620 A1 12/2012 White et al.
2013/0005544 A1 * 1/2013 Butler ..... A63B 21/4035 482/139
2013/0040791 A1 * 2/2013 Bornstein ..... A63B 21/0442 482/124
2013/0053226 A1 * 2/2013 Jiang ..... A63B 21/0414 482/129
2013/0059702 A1 * 3/2013 Page ..... A63B 21/0442 482/125
2013/0157821 A1 * 6/2013 Crowell ..... A63B 21/0442 482/129
2013/0165301 A1 * 6/2013 Thrasher-Rudd ..... A63B 7/00 482/129
2013/0190148 A1 7/2013 Allison et al.
2013/0196831 A1 * 8/2013 Kinsbourne ..... A63B 21/0442 482/129
2013/0203567 A1 8/2013 Thomas
2013/0331242 A1 * 12/2013 Wilson ..... A63B 21/0004 482/126
2014/0024508 A1 * 1/2014 Hinds ..... A63B 21/02 482/129
2014/0038793 A1 * 2/2014 Hetzel ..... A63B 21/045 482/122
2014/0121077 A1 * 5/2014 Hsieh ..... A63B 21/0442 482/124
2014/0155233 A1 * 6/2014 Latronica ..... A63B 21/0442 482/124
2014/0235413 A1 * 8/2014 Pfitzer ..... A63B 21/0023 482/129
2014/0256514 A1 * 9/2014 Garner ..... A63B 69/187 482/91
2014/0274569 A1 * 9/2014 Lewen ..... A63B 7/02 482/24
2014/0274601 A1 * 9/2014 Crowell ..... A63B 21/0555 482/121
2014/0315666 A1 * 10/2014 Medley ..... A63B 69/0059 473/450
2014/0329648 A1 * 11/2014 Luis Jacobo ..... A63B 21/0552 482/125
2014/0342883 A1 * 11/2014 Joost ..... A63B 21/0442 482/129
2014/0357458 A1 * 12/2014 Callanan ..... A63B 21/02 482/129
2015/0005141 A1 * 1/2015 Krahling ..... A63B 21/0442 482/124
2015/0335937 A1 * 11/2015 Park ..... A63B 21/0555 482/121

* cited by examiner

EXERCISE DEVICE INCLUDING ELASTIC CLOSED LOOP RESISTANCE TENSION BAND

CROSS REFERENCE TO RELATED APPLICATIONS

This application claims the benefit of U.S. Provisional Application No. 61/905,776 filed on Nov. 18, 2013, which is incorporated herein by reference.

BACKGROUND

Resistance exercise techniques typically involve the use of weight machines or free weights. Walking through a local gym or fitness club reveals racks of free weights and numerous other space-hogging benches and weight machines, many designed to exercise a single muscle group. For most people, the sheer bulk of the equipment forecloses any possibility of a comprehensive home fitness center comprised of traditional equipment. In addition, a comprehensive set of traditional resistance fitness equipment may be prohibitively expensive. Due to these space and cost restraints, individuals are faced with the decision of purchasing a gym membership and commuting to the gym or buying space-saving but less comprehensive "home gym" equipment.

Individuals seeking to maintain a regular regimen of resistance exercise face additional challenges when traveling for business or pleasure. During travel, one often finds that fitness centers in hotels have little to no resistance equipment or that the campground or similar location is completely lacking any sort of fitness equipment at all. Traditional resistance equipment is just not mobile, and even more compact "home gyms" are too bulky to conveniently take on trips.

In addition to cost and portability issues, traditional free weights have limitations. Their mode of operation relies on the law of gravity and therefore they only supply a downward force. Moreover, safely working with free weights often requires a second person, a "spotter," which puts limitations on where and how often the equipment may be used.

Also, traditional exercise equipment such as free weights and weight machines generally operate to isolate and fatigue muscles through movement in a single plane. This equipment, therefore, provides limited range of motion. A growing trend in fitness is towards functional training, which enhances normal body movements instead of isolating one muscle at a time. Traditional exercise equipment does not provide this level of freedom.

Inelastic straps have been used to enhance traditional exercise equipment to vary the angles at which a user encounters resistance. Gravity still provides the resistance, but the inelastic straps redirect the resistance force. The effectiveness of these devices depends on the user being able to perform a wide variety of exercises according to their strength, weight, height, or physical limitations. Resistance exercise devices having inelastic straps, however, often restrict the dynamic motion of the individual's arms, legs, torso, or the movement between the individual and the attachment anchor point. Inelastic exercise devices can be compact and portable, but have limited usefulness as a result of their resistance characteristics, which, like traditional exercise equipment, still depend on gravity to create the resistance. This limits the number of potential exercises that the user can accomplish.

Also, often different users may not be able to effectively use the same inelastic strap device for the same exercise due to differences in the users' height, weight, or strength. Different users may need to readjust the device or use a different device to create the proper vector angles necessary to provide sufficient resistance according to the user's physical characteristics.

Another limitation of an inelastic resistance device is that the anchoring point which is often a door must be sturdy enough to support at least the user's entire body weight. Glass door anchor points, for example, would be insufficiently strong for the user to perform inelastic resistance strap exercises without causing damage. Inelastic resistance devices may also be limited in that they often must be anchored in an above down fashion so that the user's weight may effectively become the resistance via gravity. Therefore, inelastic devices do not provide a diverse enough array of exercises.

Inelastic resistance devices also do not allow for total body muscle engagement when performing different exercises which includes non-consistent abdominal core engagement. Transitioning from an open chain (double hand/feet) exercise to a closed chain (single hand/foot) exercise takes a tedious rearrangement of an inelastic resistance strap that can sometime prove to be unsafe for the user if not arranged properly.

Another form of resistance exercise device involves an elastic resistance band that can be attached to a fixed location such as a door. While these devices may overcome some of the limitations of the inelastic devices previously discussed, they may have some limitations of their own. Some of these devices work properly only in combination with various separate attachments such as handles, foot slings, and even separate door and universal anchor attachments. These attachments require changes to the device's configuration that are cumbersome and that decrease the ease of use, effectiveness and portability of these products.

For the foregoing reasons, there is a need for affordable, compact and portable resistance training equipment and techniques that provide the ability to perform a comprehensive workout regimen at home or while traveling. These devices would eliminate the need for a traditional gym and the inherent problems with using a traditional gym such as inaccessibility, wasted travel time, and expense. Furthermore, there is a need for resistance training equipment that facilitates multi-planar and functional training exercises in addition to traditional isolation-based exercises.

There is also a need for a resistance exercise device that provides uniform resistance with no additional attachments. Such a device would provide greater of ease of use while allowing for a vast array of stances and exercises that provide resistance and proper, consistent, and effective muscle engagement. In addition, there is a need to provide such a device that is also easily portable and capable of easily being anchored to various anchoring locations for exercising.

SUMMARY

The present disclosure describes a training device that includes an elastic loop. The elastic loop device provides uniform resistance (i.e., tension) while providing total body muscle engagement whether conducting isometric, concentric, or eccentric muscle contractions. The exercise device has attached sliding bilateral hand grips with bilateral foot cradles which allows the resistance within the elastic loop to be changed with extreme ease so the user has improved control and versatility when performing exercises. The disclosed training device is a complete and self-contained exercise device that requires no additional separate attachments for a user to achieve complete and varied exercise regimens. The device provides portability, ease of use and greater effectiveness for the user while exercising.

BRIEF DESCRIPTION OF THE DRAWINGS

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 1:
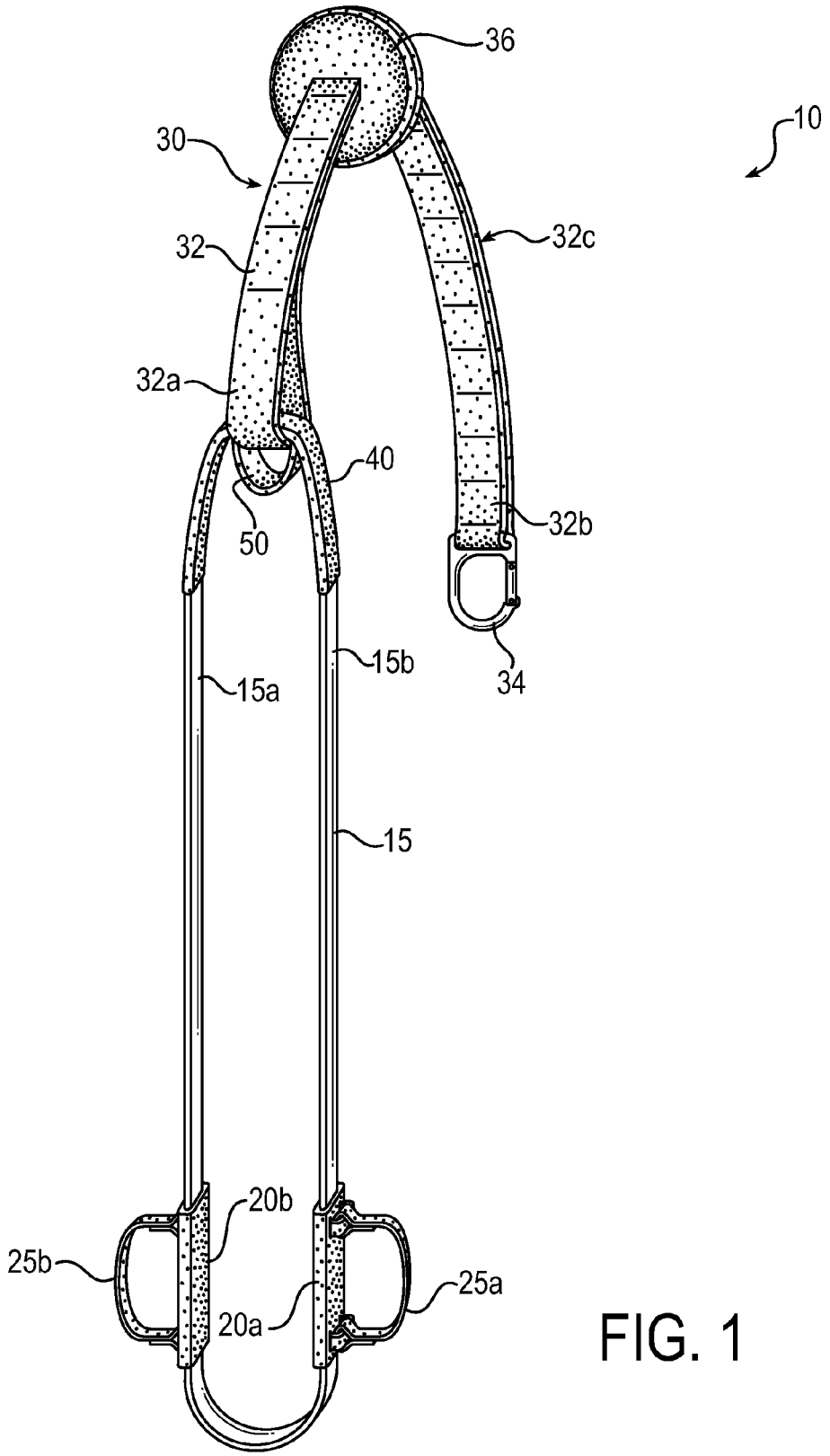
FIG. 1 illustrates an exemplary training device.

FIG. 1 illustrates a training device 10, which is a complete and self-contained device requiring no additional separate attachments for a user to achieve complete and varied exercise regimens. The device 10 provides portability, ease of use and greater effectiveness for the user while exercising.

The training device 10 includes an elastic loop 15. The elastic loop 15 provides uniform resistance (i.e., tension) while providing total body muscle engagement whether conducting isometric, concentric, or eccentric muscle contractions. In the illustrated embodiment, the elastic loop 15 is circular in shape and has a rectangular cross section that makes the inner surface 15*a* and the outer surface 15*b* mainly flat. In other embodiments, the elastic loop 15 may have cross sections other than rectangular such as, for example, a circular cross section that makes the elastic loop 15 tube-shaped.

In the illustrated embodiment, the elastic loop 15 is a continuous band. In other embodiments, the elastic loop may be a non-continuous band that is joined or tied to close the loop. The illustrated continuous arrangement, however, is preferred because in most circumstances the continuous elastic loop 15 will be stronger and more durable than a non-continuous band.

The elastic loop 15 may be made of rubber, latex, or any other known elastic or elastomeric material. In the illustrated embodiment, the elastic loop 15 is a continuous rubber strip. The elastic loop 15 may be made of a single layer of elastic material or of multiple layers. A thicker band typically provides more resistance than a thinner band of the same diameter and material.

In one embodiment, the elastic loop 15 has a cross section of 2 inch width×3/16 inch thickness. In another embodiment, the elastic loop 15 has a cross section of 1 1/8 inch width×3/16 inch thickness. In yet another embodiment, the elastic loop 15 has a cross section of 3/4 inch width×3/16 inch thickness. In other embodiments, the elastic loop 15 has cross sections other than these. In some embodiments, the elastic loop 15, while unstretched, is between 6 and 24 feet in circumference. In other embodiments, the elastic loop 15 may have other circumferences, such as, for example, less than 6 feet or more than 24 feet.

The training device 10 also includes hand grips 20*a* and 20*b*. See FIG. 2 for more detail. While in the illustrated embodiment the device 10 has two hand grips 20*a* and 20*b*, in other embodiments the device 10 may include a single hand grip or more than two hand grips.

In the illustrated embodiment, the hand grips 20*a-b* are non-rigid. In other embodiments, the hand grips 20*a-b* may be rigid. The illustrated non-rigid hand grips 20*a-b* are preferred, however, because non-rigid hand grips flex almost as one with the elastic loop 15 giving the user more flexibility than rigid hand grips. Non-rigid hand grips may be fabricated of softer materials (e.g., fabrics such as cotton, polyester, MemBrain®, Gore-Tex®, etc., leather, and so on) that that are easier on the hands of the user and on the elastic loop 15, which may increase the durability of the device 10. Non-rigid hand grips may also be more compliant and thus easier to store adding to the ease of transportability and storage of the device 10.

As indicated above, the hand grips 20*a-b* are installed wrapped around a portion of the elastic loop 15. The hand grips slide in reference to the elastic loop 15. This slidable relationship between the hand grips 20*a-b* and the elastic loop 15 make the device 10 extremely adjustable to users of all sizes and to a large array of exercises. The sliding hand grips 20*a-b* or handles also allow for the user to switch between single and double handed exercises simultaneously with zero pause in the exercise routine. The handles of the exercise device 10 may also contain heart rate monitor sensors which assist the user to gauge their target heart rate therefore giving the user the ability to visualize their target heart rate zone while working out.

Figure 2:
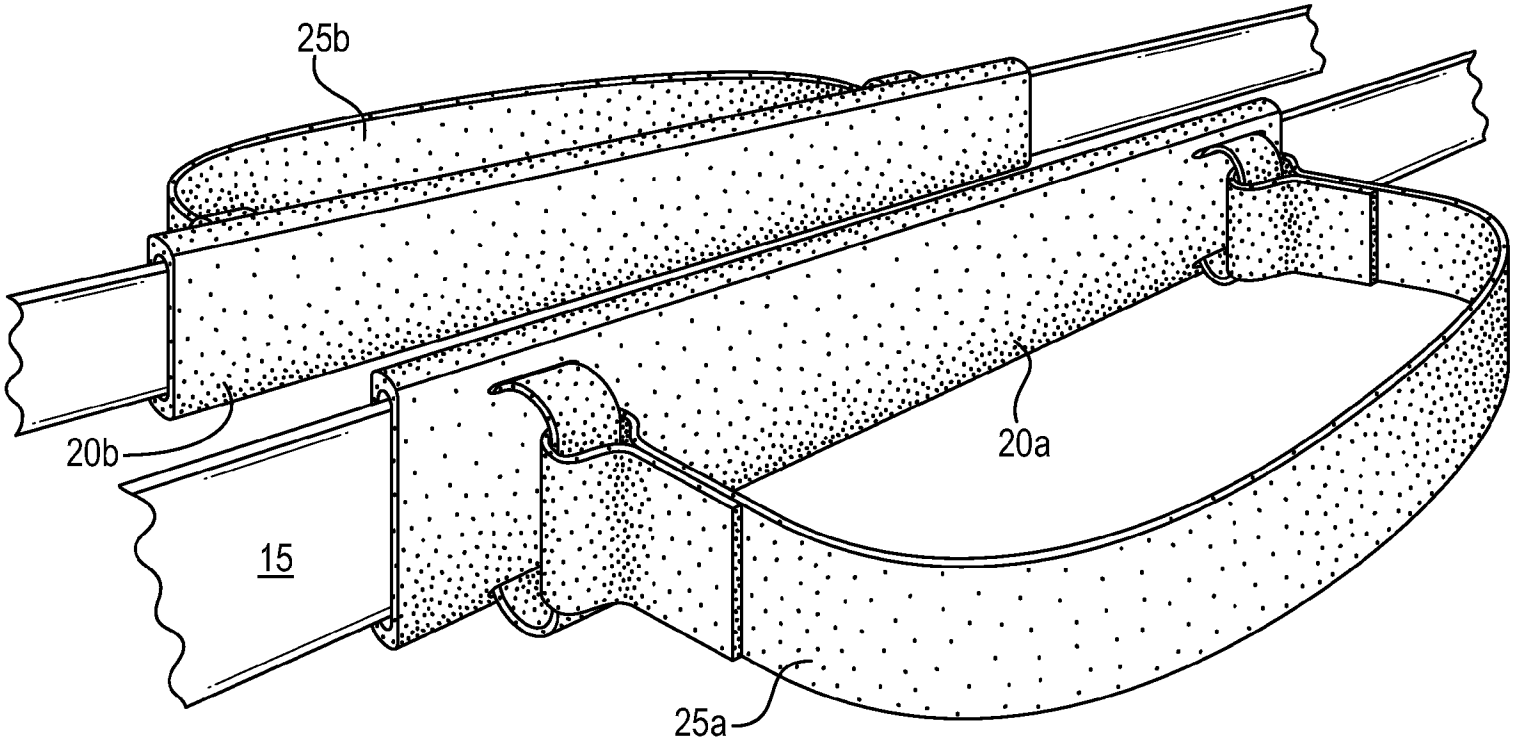
FIG. 2 illustrates a magnified view of the training device of FIG. 1 including hand grips and foot cradles.

In the illustrated embodiments of FIGS. 1 and 2, the device 10 includes foot cradles 25*a-b* that are attached or otherwise operatively connected to the hand grips 20*a-b*. The foot cradles 25*a-b* receive the feet of the user for the user to exert force upon the training device 10 while anchored thereby stretching the elastic loop 15. See FIG. 8. The functionality of the foot cradles 25*a-b* is similar to that of the hand grips 20*a-b* described above. The foot cradles may slide in reference to the elastic loop 15 to provide ease of adjustment and flexibility. Preferably, the exercise device 10 has attached sliding bilateral hand grips with bilateral foot cradles which allows the resistance within the elastic loop 15 to be changed with extreme ease so the user has improved control and versatility when performing exercises.

While in the illustrated embodiment the foot cradles 25*a-b* are connected to the hand grips 20*a-b*, in other embodiments, the foot cradles 25*a-b* are not connected to the hand grips 20*a-b*. And, while in the illustrated embodiment the device 10 has two foot cradles 25*a-b*, in other embodiments the device 10 may include a single foot cradle or more than two.

With continued reference to FIG. 1, the device 10 includes an anchoring portion 30. See also FIGS. 3 and 4 for more detail. As explained in more detail below, the anchoring portion 30 is attached to the elastic loop 15 to anchor the device 10 to a door, pole, etc. such that the user may exert force upon the training device 10 away from the anchoring portion 30 thereby stretching the elastic loop. See FIGS. 6 and 7.

The anchoring portion 30 includes a strap 32 that has a loop at a near end 32*a*, a fastener 34 at a distal end 32*b*, and a door anchor 36 therebetween. The loop at the near end 32*a* connects the anchoring portion 30 to the elastic loop 15 with a non-scissoring sleeve 40 (to be described in more detail below) therebetween.

Figure 4:
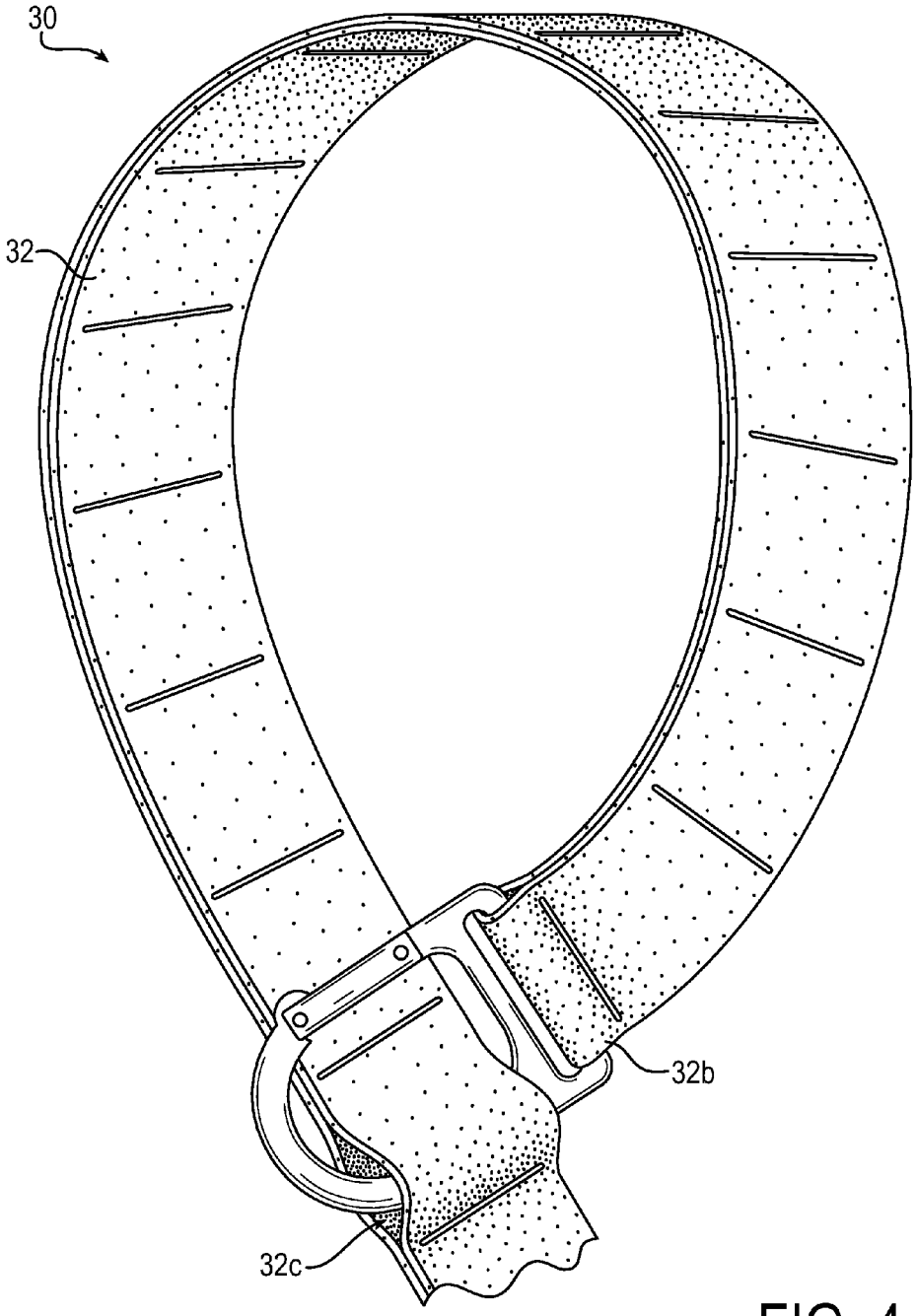
FIG. 4 illustrates a magnified view of the training device of FIG. 1 including an anchoring portion having a fastener engaging a fastening channel.
Figure 7:
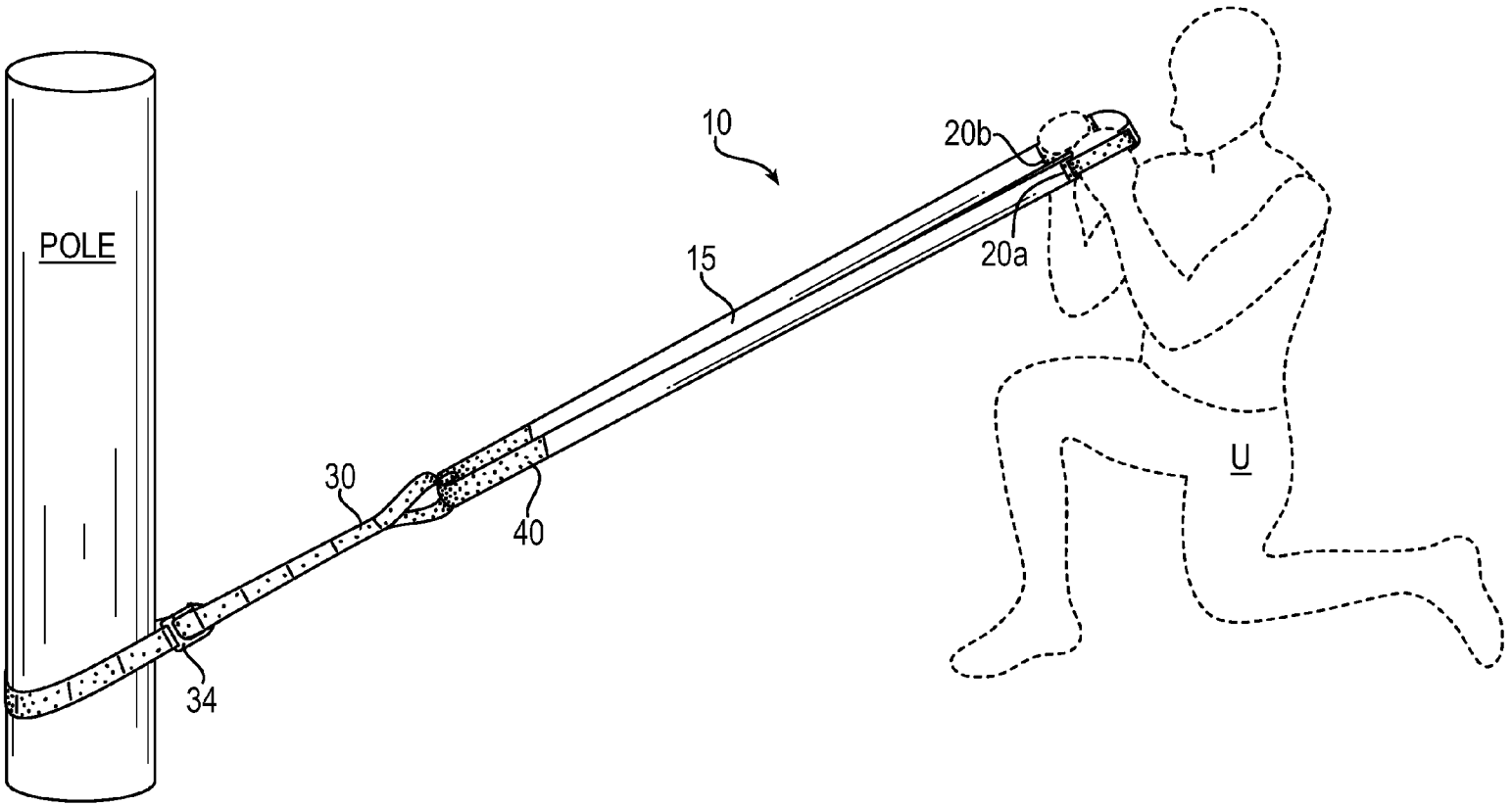
FIG. 7 illustrates a user performing exercises using hand grips of a device anchored to a pole.
Figure 8:
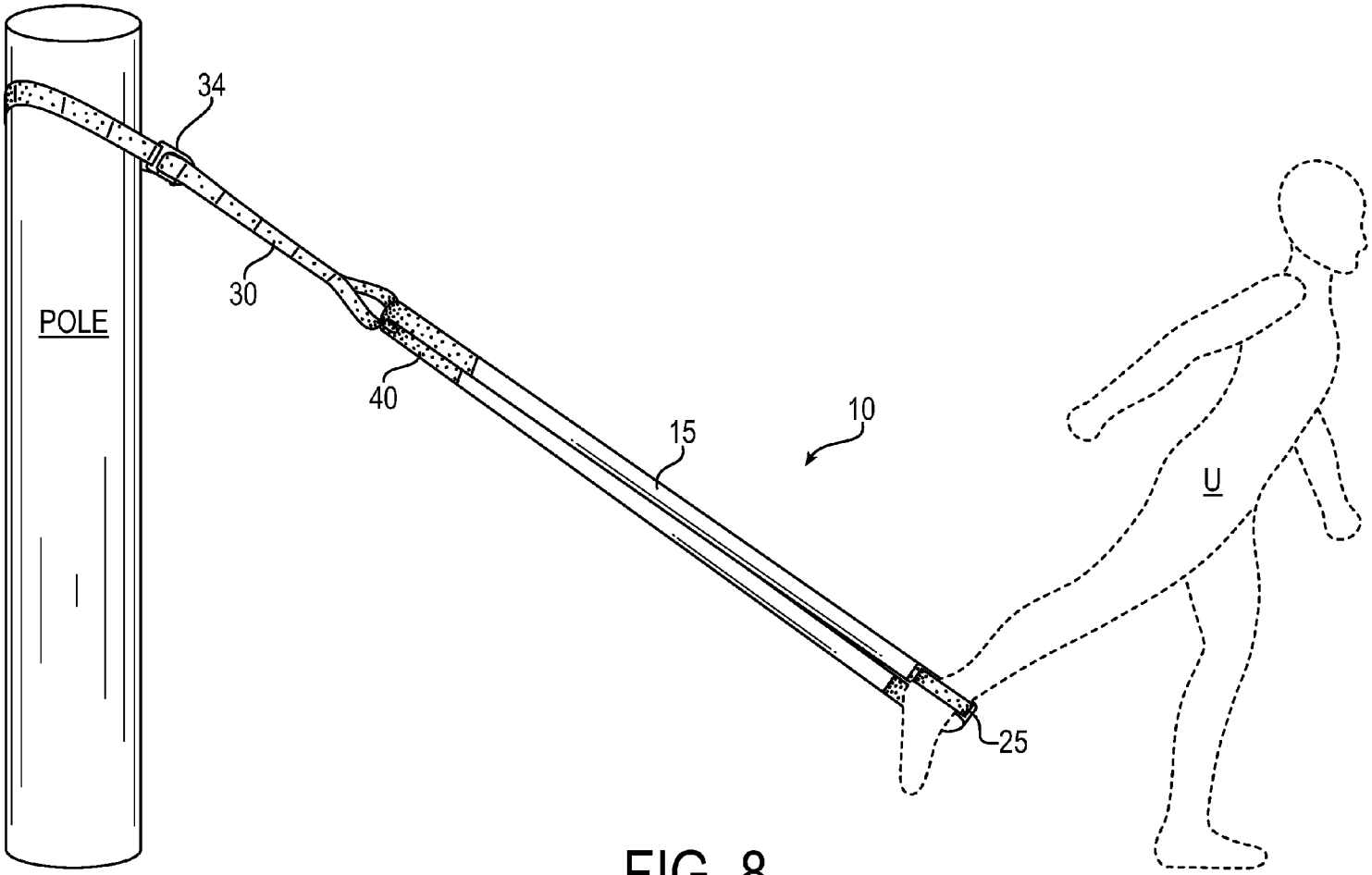
FIG. 8 illustrates a user performing exercises using foot cradles of a device anchored to a pole.

As best shown in FIG. 4, the fastener 34 may engage the strap 32 forming a loop to anchor the training device 10 to an object encircled by the second loop. In the examples of FIGS. 7 and 8, the training device has been anchored to a pole. The user U may exert force upon the training device away from the pole using the hand grips 20*a-b* or the foot cradles 25*a-b* while the device 10 is anchored to the pole thereby stretching the elastic loop.

In the illustrated embodiment of FIG. 4, the strap 32 includes channels 32*c* that have dimensions corresponding to dimensions of the fastener 34 such that the fastener 34 may engage the strap 32 at one of the channels 32*c* forming the loop to anchor the training device 10 to the object encircled by the loop. Multiple channels 32*c* may be formed (e.g., sewn, glued, fastened, etc.) along at least a portion the strap 32 providing for different sizes of objects around which the device 10 may be anchored.

In the illustrated embodiment, the fastener 34 is a carabiner. The carabiner can be of any appropriate size. For example, it could be one to two inches from top to bottom. Alternatively, it could be larger, for example, four to eight inches from top to bottom. It could be half an inch to four inches wide. In other embodiments, a carabiner of different dimensions or shape from those shown and described may be used or a fastener other than a carabiner may be used.

Figure 3:
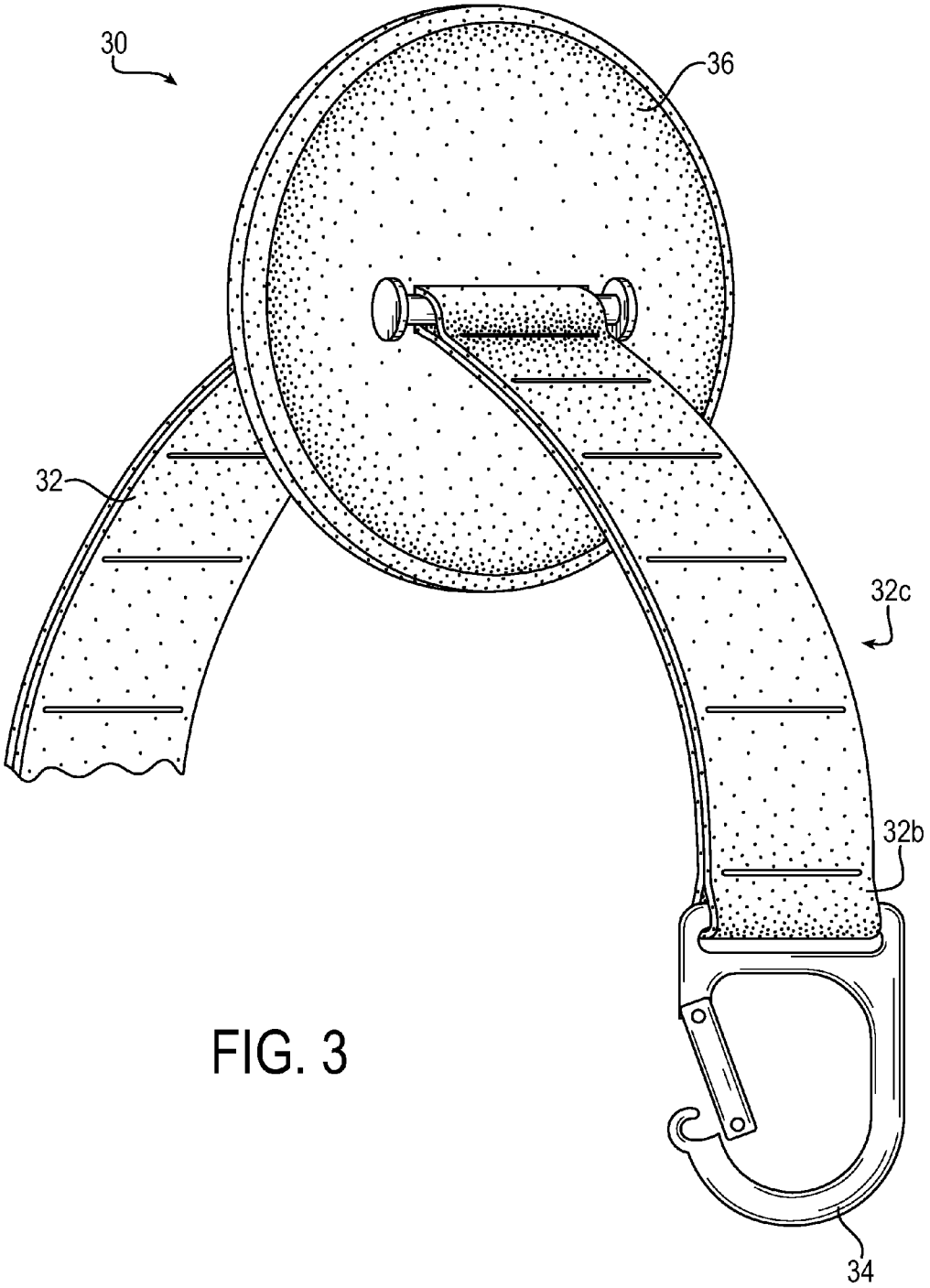
FIG. 3 illustrates a magnified view of the training device of FIG. 1 including an anchoring portion having a door anchor, a fastener and fastening channels.

As best shown in FIG. 3, the door anchor 36 is attached (i.e., sewn, glued, etc.) to the strap 32. The strap 32 has a thickness such that the strap 32 may pass through a slot between the door and a door frame or the floor. See FIG. 6. The door anchor 36 is retained on an opposite side of the door from the elastic loop 15 to anchor the training device 10 to the door. Although in the illustrated embodiments the door anchor 36 is shown as circular, in other embodiments the door anchor 36 may have other shapes (e.g., square, rectangular, triangular, etc.) The user U may exert force upon the training device away from the door using the hand grips 20*a-b* or the foot cradles 25*a-b* while the device 10 is anchored to the door thereby stretching the elastic loop.

In one embodiment, the strap 32 has a thickness smaller than 0.25 inches and the door anchor has at least one dimension larger than 0.25 inches. In another embodiment, the strap 32 has a thickness smaller than 0.5 inches and the door anchor has at least one dimension larger than 0.5 inches. In yet another embodiment, the strap 32 has a thickness smaller than 0.75 inches and the door anchor has at least one dimension larger than 0.75 inches. In other embodiments, the strap 32 and the door anchor 36 may have other dimensions. In one embodiment, the door anchor 36 has a shape conforming to a shape of a portion of the door to anchor the training device 10 to the portion of the door.

Figure 6:
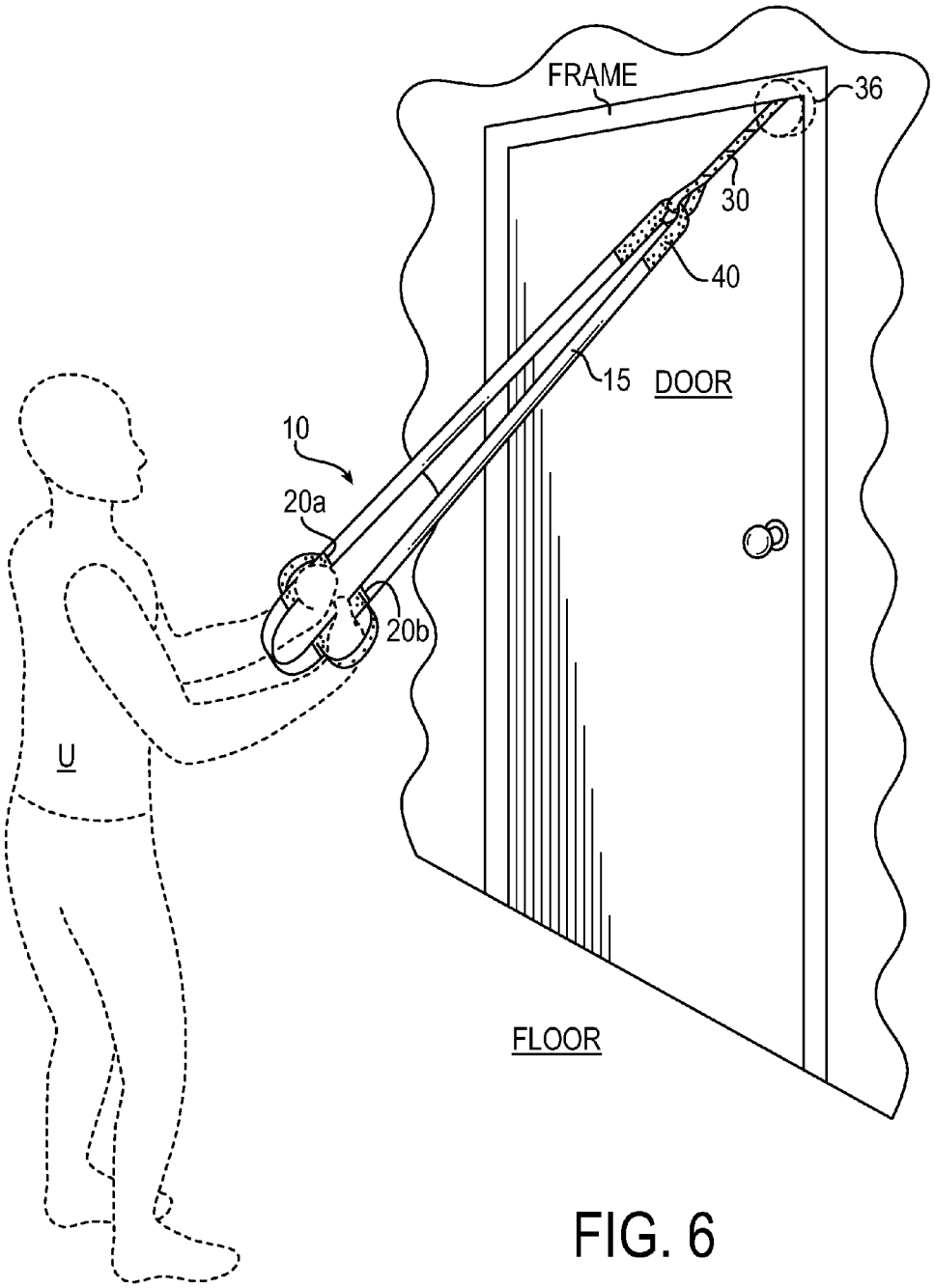
FIG. 6 illustrates a user performing exercises using a device anchored to a door.

FIGS. 6, 7 and 8 illustrate examples of a user U performing exercises using the device 10 disclosed herein. In FIG. 6, the user U is shown performing a diagonal pull-down exercise. In FIG. 7, the user U is shown performing a biceps curl exercise. In FIG. 8, the user U is shown performing a leg push exercise. Other exercises that may be performed using the device 10 include standing press, lat pull-down, squat, core twist, etc. Exercises that may be performed using the device 10 include those shown and a near infinite number of other exercises. Those exercises can include single-planar or multi-planar exercises. A multi-planar exercise is one which involves movements in multiple planes. For example, if an exercise involves both horizontal and vertical resistance, it is multi-planar.

Exercises may also include core or multi-muscle exercises. Some of these exercises may help the user U improve posture, stabilize the core, and potentially relieve and/or prevent lower back pain. For example, the user may use the device 10 to perform resistance running, which is similar to parachute running (i.e., running with a parachute attached to the exerciser's body). Resistance running is more effective than treadmill running because it engages core and dynamic muscle groups through every step. The user may perform resistance running by anchoring the device 10 to a pole, for example, and engaging the elastic loop 15 around the user's core. The user may then run or jump in place in a straight line or side to side, and the device 10 will resist the user's movements. Thus, the user may perform an exercise very similar in action and effect to parachute running, but in a way that is much more convenient because the device 10 requires much less space than a parachute.

Figure 5:
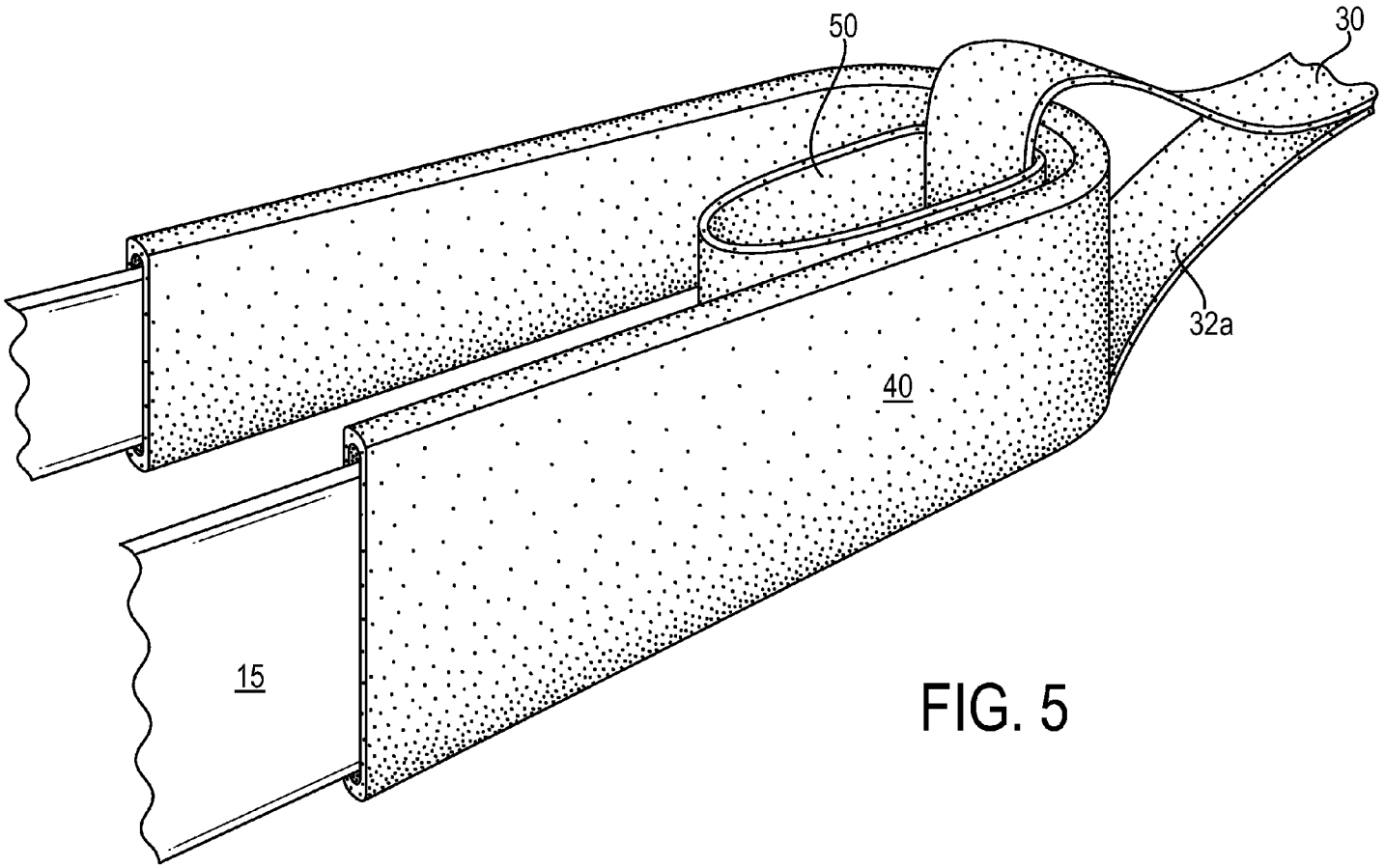
FIG. 5 illustrates a magnified view of the training device of FIG. 1 including an anchoring portion an elastic loop and a non-scissoring sleeve therebetween.

A problem may be that the durability and safety of the elastic portion 15 may be compromised by scissoring of the elastic loop 15 by the anchoring portion 30 when force is exerted upon the training device 10 while anchored. As shown in more detail in FIG. 5, the device 10 may include a non-scissoring sleeve 40 wrapped around the elastic loop 15. The loop at the near end 32*a* connects the anchoring portion 30 to the elastic loop 15 with the non-scissoring sleeve 40 therebetween. The non-scissoring sleeve 40 reduces scissoring of the elastic loop 15 by the anchoring portion 30 when force is exerted upon the training device 10 while anchored. The non-scissoring sleeve 40 may be fabricated of a material (e.g., fabric such as cotton, polyester, MemBrain®, Gore-Tex®, etc., leather, and so on) that may be more resistant to the respective forces than the elastomeric material from which the elastic loop 15 is made. This would increase the life of the elastic loop 15 and make the device 10 more reliable and safer.

The non-scissoring sleeve 40 may slide along the elastic loop 15 making use and adjustment of the device 10 easier. The non-scissoring sleeve 40, however, does not slide relative to the anchoring portion 30 to ensure that the elastic loop 15 is always protected from excessive scissoring that may otherwise be caused by the anchoring portion 30. Thus, the non-scissoring sleeve 40 is slidably connected to the elastic loop 15 and non-slidably connected to the anchoring portion 30.

The training device 10 may also include a trap 50 that is connected to the non-scissoring sleeve 40 and the anchoring portion 30 to retain the non-scissoring sleeve 40 and the anchoring portion 30 in their non-slidably connected relationship. The trap 50 may include a loop of fabric attached (e.g., sewn, glued, fastened, etc.) to the non-scissoring sleeve 40 or the anchoring portion 30. In other embodiments, the trap 50 may include other methods of fastening the non-scissoring sleeve 40 and the anchoring portion 30 to retain the non-scissoring sleeve 40 and the anchoring portion 30 in their non-slidably connected position.

In one embodiment, the exercise device 10 includes a small video camera (not shown) mounted within the non-scissoring sleeve 40 which allows the user to self-video record exercises which can be uploaded and shared via internet or blue tooth connection.

An "operable connection," or a connection by which entities are "operably connected," is one in which the entities are connected in such a way that the entities may perform as intended. An operable connection may be a direct connection or an indirect connection in which an intermediate entity or entities cooperate or otherwise are part of the connection or are in between the operably connected entities.

"User," as used herein, includes but is not limited to one or more persons, software, computers or other devices, or combinations of these.

While example systems, methods, and so on, have been illustrated by describing examples, and while the examples have been described in considerable detail, it is not the intention to restrict or in any way limit the scope of the appended claims to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, and illustrative examples shown or described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2 d. Ed. 1995).

What is claimed is:

1. A training device comprising:

a continuous elastic loop having a cross section that is rectangular in shape, wherein the continuous elastic loop is formed from a single layer of material that provides a uniform resistance when placed in tension, and a cross sectional width of the loop in a range from ¾ inch to 2 inches, and a perimeter of the loop in a range from 6 feet to 24 feet;

an anchoring portion including a strap and a door anchor operatively connected to the strap, wherein the strap has a distal end and a looped near end and the door anchor is positioned intermediate the distal end and the looped near end so as to be retained relative to a door to anchor the training device, such that when the door anchor is retained by the door the distal end is disposed on an opposite side of the door than the continuous elastic loop;

a non-scissoring flexible sleeve slidably wrapped around a first portion of the continuous elastic loop and non-slidably connected to the looped near end of the strap of the anchoring portion, wherein the non-scissoring flexible sleeve extends through the looped near end while wrapped around the first portion of the continuous elastic loop; and at least one non-rigid hand grip slidably wrapped around a second portion of the continuous elastic loop and configured to receive at least one hand of a user around the second portion of the continuous elastic loop for the user to exert force away from the door upon the training device while anchored thereby stretching the continuous elastic loop.

2. The training device of claim 1, further comprising:

a trap fixedly connected to the non-scissoring flexible sleeve and operably connected to the anchoring portion to retain the non-scissoring flexible sleeve and the anchoring portion in the non-slidably connected relationship; and an inner surface of the continuous elastic loop, wherein the trap is disposed inwardly from the inner surface.

3. The training device of claim 1, further comprising:

a fastener disposed at the distal end of the strap opposite the looped near end of the strap operatively connected to the non-scissoring flexible sleeve and configured for the fastener to engage the strap forming a second loop to anchor the training device to an object encircled by the second loop, wherein the strap includes channels configured for the fastener to engage the strap at one of the channels forming the second loop to anchor the training device to the object encircled by the second loop;

wherein the channels and the fastener are disposed on the opposite side of the door relative to the continuous elastic loop when the door anchor is retained by the door.

4. The training device of claim 1, further comprising:

at least one foot cradle fixedly secured to the at least one non-rigid hand grip slidably connected to the continuous elastic loop and configured to receive at least one foot of a user for the user to exert force upon the training device while anchored thereby stretching the continuous elastic loop.

5. A training device comprising:

a continuous elastic loop having a cross section that is rectangular in shape, wherein the continuous elastic loop is formed from a single layer of material that provides a uniform resistance when placed in tension, and a cross sectional width of the loop in a range from ¾ inch to 2 inches, and a perimeter of the loop in a range from 6 feet to 24 feet, the continuous elastic loop having attached thereon at least one of a hand grip or a foot cradle;

a non-scissoring flexible sleeve slidably wrapped around a first portion of the continuous elastic loop;

an anchoring portion non-slidably connected to the non-scissoring flexible sleeve; and the anchoring portion comprising a strap having a distal end and a looped near end, wherein the non-scissoring flexible sleeve is connected with the looped near end while extending therethrough and wrapped around the first portion of the continuous elastic loop.

6. The training device of claim 5, wherein the anchoring portion includes:

the strap having a fastener at the distal end, the looped near end non-slidably connecting the anchoring portion to the non-scissoring flexible sleeve and the fastener configured to engage the strap forming a second loop to anchor the training device to an object encircled by the second loop.

7. The training device of claim 6, wherein the strap includes channels having dimensions corresponding to dimensions of the fastener such that the fastener engages the strap at one of the channels forming the second loop to anchor the training device to the object encircled by the second loop.

8. The training device of claim 5, wherein the anchoring portion includes:

the strap having a door anchor positioned along the strap intermediate the looped near end and the distal end, and the looped near end non-slidably connecting the anchoring portion to the non-scissoring flexible sleeve and the door anchor configured to be retained relative to a door to anchor the training device such that when the door anchor is retained by the door the distal end of the strap is disposed on an opposite side of the door than the continuous elastic loop.

9. The training device of claim 5, wherein the anchoring portion includes:

the strap having a door anchor positioned along the strap intermediate the looped near end and the distal end, and the looped near end non-slidably connecting the anchoring portion to the non-scissoring flexible sleeve, wherein the strap has a thickness smaller than 0.25 inches and the door anchor has at least one dimension larger than 0.25 inches such that the strap passes through a slot between a door and a door frame or a floor while the door anchor is retained on an opposite side of the door from the continuous elastic loop to anchor the training device.

10. The training device of claim 5, wherein the anchoring portion includes:

the strap having a door anchor positioned along the strap intermediate the looped near end and the distal end, and the looped near end non-slidably connecting the anchoring portion to the non-scissoring flexible sleeve, wherein the strap has a thickness smaller than 0.5 inches and the door anchor has at least one dimension larger than 0.5 inches such that the strap passes through a slot between a door and a door frame or a floor while the door anchor is retained on an opposite side of the door from the continuous elastic loop to anchor the training device.

11. The training device of claim 5, wherein the anchoring portion includes:

the strap having a door anchor positioned along the strap intermediate the looped near end and the distal end, and the looped near end non-slidably connecting the anchoring portion to the non-scissoring flexible sleeve, wherein the strap has a thickness smaller than 0.75 inches and the door anchor has at least one dimension larger than 0.75 inches such that the strap passes through a slot between a door and a door frame or a floor while the door anchor is retained on an opposite side of the door from the continuous elastic loop to anchor the training device.

12. The training device of claim 5, wherein:

the hand grip is a non-rigid hand grip slidably wrapped around a second portion of the continuous elastic loop and configured to receive at least one hand of a user around the second portion of the continuous elastic loop for the user to exert force upon the continuous elastic loop away from the anchoring portion thereby stretching the continuous elastic loop, wherein stretching the uninterrupted continuous elastic loop provides uniform resistance.

13. A training device comprising:

a single layer continuous elastic loop providing a uniform resistance when placed in tension, the single layer continuous elastic loop having a cross section that is rectangular in shape, and a cross sectional width of the loop in a range from ¾ inch to 2 inches, and a perimeter of the loop in a range from 6 feet to 24 feet;

an anchoring portion including a strap and a fastener disposed at a distal end of the strap opposite a looped near end of the strap to which the strap operatively connects to the continuous elastic loop and configured for the fastener to engage the strap forming a second loop to anchor the training device to an object encircled by the second loop;

a non-scissoring flexible sleeve slidably wrapped around a first portion of the single layer continuous elastic loop and non-slidably connected to the anchoring portion, wherein the non-scissoring flexible sleeve extends through the looped near end while wrapped around the first portion of the single layer continuous elastic loop; and at least one non-rigid hand grip slidably wrapped around a second portion of the single layer continuous elastic loop and configured to receive at least one hand of a user around the second portion of the single layer continuous elastic loop for the user to exert force away from the object upon the training device while anchored thereby stretching the single layer continuous elastic loop.

14. The training device of claim 13, further comprising:

an inner surface and an outer surface on the single layer continuous elastic loop;

a trap fixedly connected to the non-scissoring flexible sleeve and operatively connected to the anchoring portion to retain the non-scissoring flexible sleeve and the anchoring portion in the non-slidably connected position;

wherein the trap is positioned interior the single layer continuous elastic loop offset from the inner surface, wherein the offset of the trap from the inner surface is equal to a thickness of the non-scissoring flexible sleeve.

15. The training device of claim 13, further comprising at least one of:

at least one foot cradle slidably connected to the single layer continuous elastic loop and configured to receive at least one foot of a user for the user to exert force upon the training device while anchored thereby stretching the continuous elastic loop, or at least one foot cradle operatively connected to the non-rigid hand grip and configured to receive at least one foot of a user for the user to exert force upon the training device while anchored thereby stretching the single layer continuous elastic loop.

16. The training device of claim 13, wherein the strap includes channels of a size and shape corresponding to the fastener to engage the strap at one of the channels forming the second loop to anchor the training device to the object encircled by the second loop.

17. The training device of claim 13 further comprising:

a door anchor operatively connected to the strap and configured to be retained relative to a door to anchor the training device.

18. The training device of claim 13 further comprising:

a door anchor operatively connected to the strap and configured to be retained relative to a door to anchor the training device, wherein the door anchor has a shape conforming to a shape of a portion of the door to anchor the training device to the portion of the door.

19. The training device of claim 1, wherein the non-scissoring flexible sleeve has a width measured in a first direction which is larger than its thickness measured in a direction perpendicular to the first direction.

20. The training device of claim 13, wherein the non-scissoring flexible sleeve has a width measured in a first direction which is larger than its thickness measured in a direction perpendicular to the first direction.

* * * * *